US007093540B2

(12) United States Patent
Giancaterino et al.

(10) Patent No.: US 7,093,540 B2
(45) Date of Patent: Aug. 22, 2006

(54) METHOD AND DEVICE FOR INITIAL ADJUSTMENT OF THE REGISTER OF THE ENGRAVED CYLINDERS OF A ROTARY MULTICOLOR PRESS

(75) Inventors: Lucio Giancaterino, Renens (CH); Alexandre Rawyler, Lussery-Villars (CH)

(73) Assignee: Bobst S.A., (CH)

( * ) Notice: Subject to any disclaimer, the term of this patent is extended or adjusted under 35 U.S.C. 154(b) by 0 days.

(21) Appl. No.: 11/116,529

(22) Filed: Apr. 28, 2005

(65) Prior Publication Data

US 2005/0247219 A1 Nov. 10, 2005

(30) Foreign Application Priority Data

May 5, 2004 (CH) ..... 00801/04

(51) Int. Cl.
*B41I 3/02* (2006.01)
*B41F 9/02* (2006.01)

(52) U.S. Cl. ..... 101/486; 101/152

(58) Field of Classification Search ..... 101/152, 101/183, 248, 211, 181; 702/151; 399/167; 347/116

See application file for complete search history.

(56) References Cited

U.S. PATENT DOCUMENTS 3,963,902 A 6/1976 Dowd ..... 377/17
4,087,729 A * 5/1978 Yamazaki et al. ..... 318/601
4,366,542 A * 12/1982 Anselrode ..... 700/125
4,391,190 A * 7/1983 Metzler ..... 101/211
4,437,402 A * 3/1984 Fischer ..... 101/181
4,514,819 A * 4/1985 Punater et al. ..... 702/151
4,528,630 A * 7/1985 Sargent ..... 700/125
4,604,083 A * 8/1986 Barny et al. ..... 493/34
4,817,525 A * 4/1989 Yagi ..... 101/219
5,117,365 A * 5/1992 Jeschke et al. ..... 700/124
5,209,161 A 5/1993 Derivi ..... 101/211
5,239,924 A * 8/1993 Wallmann et al. ..... 101/179
5,259,307 A * 11/1993 Bourgeois et al. ..... 101/118
5,327,826 A * 7/1994 Rodi ..... 101/181
5,433,541 A * 7/1995 Hieda et al. ..... 400/279

(Continued)

FOREIGN PATENT DOCUMENTS

DE 2 753 433 5/1979

(Continued)

OTHER PUBLICATIONS

European Search Report EP 04 40 5282 dated Nov. 4, 2004.

*Primary Examiner*—Andrew H. Hirshfeld
*Assistant Examiner*—Wasseem H. Hamdan
(74) *Attorney, Agent, or Firm*—Ostrolenk, Faber, Gerb & Soffen, LLP

(57) ABSTRACT

To adjust peripheral register of engraved cylinders, the positions of a respective angular register mark arranged on each cylinder is measured with respect to a zero reference, and an angular printing mark characteristic of the position of the engraving is associated with each cylinder. The data of the job to be run are stored. The respective angular displacements of the engraved cylinders are indexed with respect to a reference cylinder in accordance with the job. By determining the web length separating two printing points of two successive engraved cylinders, this length is divided by the peripheral length of the cylinder and the remaining amount of the division is used for determining the angular indexing. Each cylinder is then brought into its angular indexed position, is first disconnected from a common transmission, and then all the cylinders are simultaneously reconnected to the transmission.

2 Claims, 1 Drawing Sheet

U.S. PATENT DOCUMENTS

| | | | | | |
|---|---|---|---|---|---|
| 5,500,801 | A | * | 3/1996 | Loffler | 700/122 |
| 5,535,675 | A | * | 7/1996 | Gentle | 101/248 |
| 5,735,205 | A | * | 4/1998 | Nordgren | 101/181 |
| 5,771,811 | A | | 6/1998 | Siler et al. | 101/486 |
| 5,816,152 | A | * | 10/1998 | Nelgner et al. | 101/181 |
| 5,828,075 | A | * | 10/1998 | Siler et al. | 250/559.44 |
| 5,901,647 | A | * | 5/1999 | Kohlmann | 101/216 |
| 6,167,806 | B1 | * | 1/2001 | Chretinat et al. | 101/220 |
| 6,499,397 | B1 | * | 12/2002 | Stern | 101/248 |
| 6,591,746 | B1 | * | 7/2003 | Siler | 101/171 |
| 6,647,874 | B1 | * | 11/2003 | Siegl et al. | 101/211 |
| 6,771,919 | B1 | * | 8/2004 | Koide | 399/167 |
| 6,862,986 | B1 | * | 3/2005 | Kersch et al. | 101/248 |

FOREIGN PATENT DOCUMENTS

| | | | |
|---|---|---|---|
| DE | 44 41 246 | | 5/1996 |
| EP | 0 070 565 | | 1/1983 |
| GB | 2119505 | A * | 11/1983 |

* cited by examiner

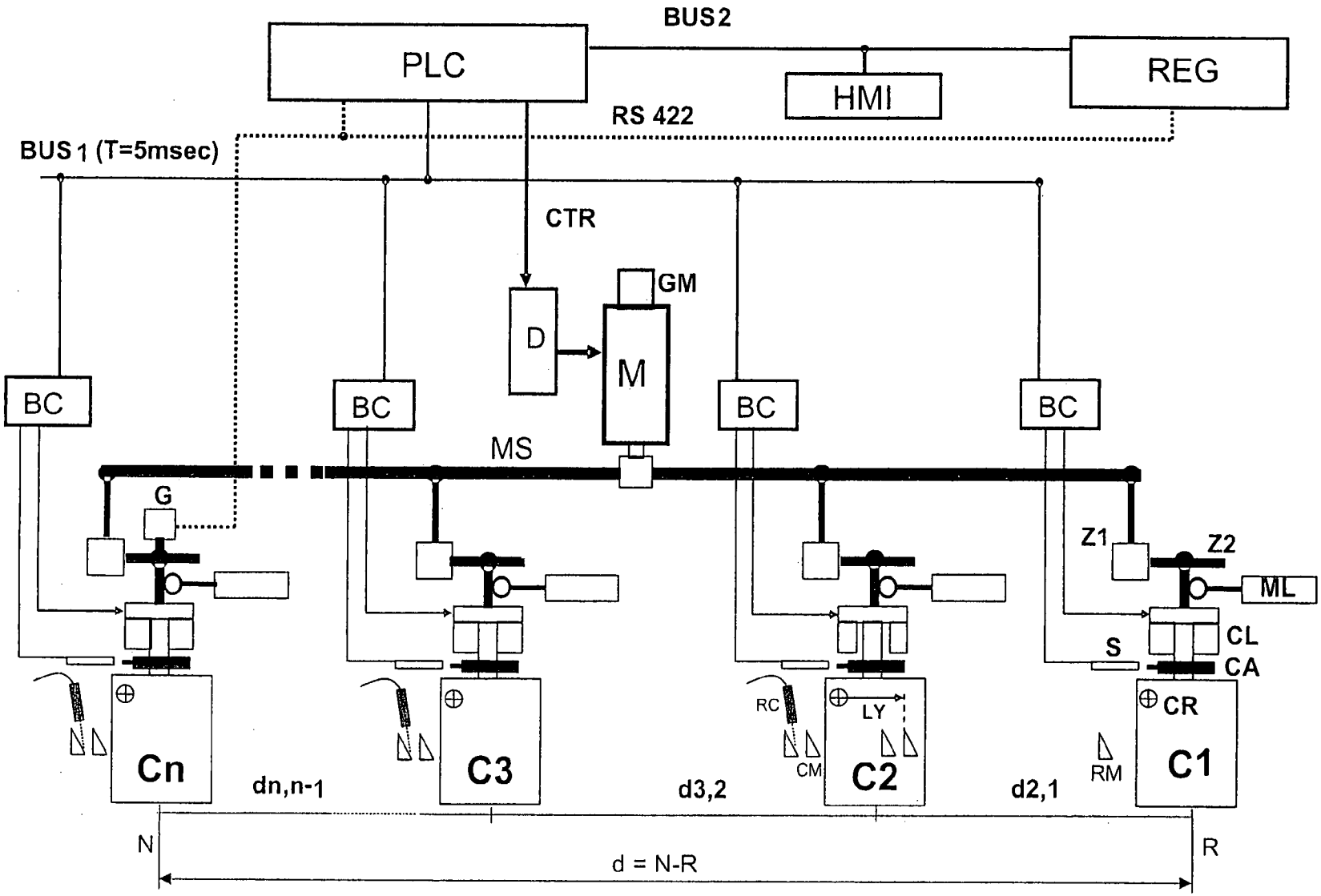
REG
HMI
BUS2
RS 422
PLC
CTR
D
GM
M
MS
BC
BC
BC
BC
BUS 1 (T=5msec)
G
Z1
Z2
ML
CL
CA
S
CR
C1
RM
d2,1
LY
C2
RC
CM
d3,2
C3
dn,n-1
Cn
R
N
d = N-R

METHOD AND DEVICE FOR INITIAL ADJUSTMENT OF THE REGISTER OF THE ENGRAVED CYLINDERS OF A ROTARY MULTICOLOR PRESS

BACKGROUND OF THE INVENTION

The present invention refers to a method for initial adjustment of the peripheral register of engraved cylinders of successive printing units of a rotary multicolor printing press in accordance with a determined job. These cylinders are connected to a common drive shaft by respective clutches, according to which an angular register mark is arranged on each cylinder and aligned with a fixed point with respect to the engraved pattern on the cylinder. These angular positions are measured and stored with respect to a zero reference. The invention also refers to a device for performing this method.

For color printing by a plurality of engraved cylinders, the various cylinders must be arranged in angular positions which are accurately determined with respect to one another. The position depends on the length of the web between the various printing units and on the size of the engraved cylinders, i.e. their peripheral or circumferential length. When considering the zero reference of the printing of each engraved cylinder, its position must be determined with respect to the zero position of the other engraved cylinders, according to the length of the web separating two successive printing units and to the peripheral length of the engraved cylinders, so that the successive printings of the different colors on the printed web are in perfect register.

An adjustment device for the register of respective positions of various engraved cylinders of such a press has already been proposed in DE 44 41 246, wherein two segments of the drive shaft between two engraved cylinders are connected by a coupling provided with an endless screw adjusting mechanism for modifying the respective angular positions of two drive shaft segments and consequently those of the two engraved cylinders connected to these respective segments.

Also, U.S. Pat. No. 3,963,902 has proposed a method and a device for repositioning printing cylinders of a rotary multicolor press driven by a common transmission line, into angular register positions known for a kind of job which is periodically repeated. Once the initial adjustment of the printing press is realized by known conventional techniques, i.e. manual adjustment by visually controlling the register of the colors on the printed paper or cardboard web, the respective positions of the different cylinders are determined by means of an angular indexing device and are stored. When the same job is to be run, the cylinders are repositioned in an angular reference position. Then, each cylinder is brought into an angular indexing position by means of a differential device driven by a motor running until the angular position of the cylinder is in register with the indexed position. This operation is repeated for each cylinder. This adjustment can be realized without a printing web positioned in the machine, thus avoiding loss of paper or cardboard.

However, this method requires a conventional initial adjustment for each new job. This adjustment is very time-consuming and uses a large amount of paper or cardboard web. Moreover, resumption of a job involves the semi-automatic positioning by the operator requiring a certain adjustment time on the machine.

A method similar to the preceding one, but using clutches between each engraved cylinder and the transmission line, is described in DE 27 53 433.

Another adjustment method using marks on engraved cylinders and couplings between the cylinders and a transmission line and which are uncoupled from their drives in correspondence with the position of their marks with respect to the marks on the chase for the adjustment of their initial positions is described in EP 0 070 565. This method requires the use of the printing web and thus causes a considerable loss of material for realizing the adjustment. Besides, such a method does not resolve the question of the initial adjustment for a first job on the printing press.

SUMMARY OF THE INVENTION

The object of the present invention is to at least partly obviate the aforesaid drawbacks.

To this aim, the present invention concerns a method for initial adjustment of the peripheral register of the engraved cylinders of the successive printing units of a rotary multicolor printing press in accordance with a determined job and a device for working the method.

According to the method of the present invention, data for the job to be run can simply be entered into the control programmer of the printing press. Based on the data, namely recto-verso printing job, the number and choice of colors and hence the choice of the working cylinders, as well as kind of drying, the path of the printing web is defined. Therefore, web lengths between the cylinders are known, and hence relative angular positions of the cylinders, which correspond to the remaining amount of the division of these lengths by the size (peripheral length) of the cylinder. Generally, all the engraved cylinders may be of the same size.

Based on the information, the initial adjustment time for all of the cylinders for a job run the first time on the printing press, for example comprising ten cylinders, should not exceed one minute without any loss of web. Because of use of this method, the printing press has exceptional versatility of application, not only for resumption of a job for which the initial adjustment has already been realized and stored, but also for the initial adjustment.

BRIEF DESCRIPTION OF THE DRAWING

The single FIGURE of the enclosed drawing illustrates, schematically and by way of example, a working mode of the method for initial adjustment of the peripheral register of the engraved cylinders of successive printing units of a rotary multicolor printing press in accordance with a determined job.

DESCRIPTION OF A PREFERRED EMBODIMENT

A multicolor rotogravure printing machine comprises a printing line comprised of a plurality of engraved cylinders each for printing another color on the continuous paper or cardboard web which unwinds in the machine. At the time each cylinder deposits ink on the support, its color must be perfectly in register with the others. If not, the various colors of the printed patterns are offset.

The maximum acceptable register error of colors is of 0.1 mm during production of the machine. For the initial adjustment of the cylinders, which is the object of the present invention, an accuracy of ±5 mm is acceptable, since the register system can correct this error owing to a compensator modifying the web length between two printing points.

The principle of the initial adjustment according to the invention is based on the automatic register of a point on the engraved cylinders which must be fixed with respect to the printed screen dot on the printing size. Once the position of this point is registered for each cylinder, the sequence of automation calculates the displacement to be done on each cylinder in order to bring it in phase with a reference cylinder corresponding to the cylinder which prints the first color. This displacement depends on the web path between the engraved cylinders, which depends on the configuration given to the machine for a given job.

The machine for performing the adjustment method according to the present invention comprises a main motor M which drives a transmission shaft MS. This shaft is connected to each engraved cylinder C1 . . . Cn by reduction gears Z1/Z2=⅓ in this example. A pneumatic gripper CL controlled by a bus coupler BC, itself connected to a programmable electronics MCS for the control of the machine, is used as clutch between the transmission shaft MS and each cylinder C1 . . . Cn.

The shaft of each engraved cylinder C1 . . . Cn carries a cam CA aligned to an angular fixed position corresponding to that of a register cross printed on each engraved cylinder C1 . . . Cn. The angular position of this cam and hence that of the register cross CR is detected by an inductive sensor S connected to the same bus coupler BC as the pneumatic gripper CL.

An incremental encoder G is associated with one of the drive shafts of one of the engraved cylinders C1 . . . Cn. It is a 4096 pulses/revolution counter making one revolution per engraved cylinder C1 . . . Cn revolution. Since all the drive shafts of the engraved cylinders rotate continuously and at the same speed, a single encoder enables the angular positions of all the engraved cylinders C1 . . . Cn to be known.

Each engraved cylinder prints a register mark, which is designated RM for the first color which is the reference color printed by the first engraved cylinder C1 and which is designated by CM for the engraved cylinder C2. These marks RM, CM are scanned by photocells RC arranged so that their scanning point is at a determined distance from the printing point on the engraved cylinders C1 . . . Cn. The web distance between the respective printing points N and R of the engraved cylinder Cn and the reference cylinder C1 corresponds to d(N−R).

LY indicates the distance on the engraved cylinder between the register cross CR of each cylinder and the reference mark RM, CM printed on the web.

For its control, the machine comprises an interface HMI man-machine, which can be a control touch screen connected to the programmable electronics MCS and to the register control electronics REG. During printing, the system REG uses the incremental encoder G and the scanning photocells RC of the register marks RM, CM printed on the printing web. A bus BUS1 (T=5 msec) is arranged between the bus couplers BC and the programmable electronics MCS and a supervision bus BUS2 is arranged between the programmable electronics MCS and the register control electronics REG. The programmable electronics MCS and the register control electronics REG use the information given by the incremental encoder G.

The main drive motor M of the printing machine is associated with a frequency modulator which receives a control signal CTR from the programmable electronics MCS for the control of the machine. This frequency modulator is used to control the main motor M in position during the initial adjustment of the engraved cylinders C1 . . . Cn. A motor encoder GM, connected to the control electronics MCS as well, allows a vectorial controlling of the motor in speed and position.

In the initial machine preparation phase for a job run the first time on this machine, the operator must align the cams CA with the register cross CR of the engraved cylinder C1 . . . Cn. This operation can be carried out only once and can be realized outside the machine.

An inking carriage (not shown) is introduced into the machine without paying attention to either the lateral or the angular positions of the cylinders C1 . . . Cn.

Before activating any automatic sequence on the machine, the data of the job to be run in the machine must be selected. For example, it must be chosen if the printing is recto or verso, if the cylinder is active or not, which kind of dryer is used and so on. The information relative to the job enables the path of the printing web in the machine to be defined. It must be introduced even on the non-selected printing units of the cylinders C1 . . . Cn which are located between two selected units. All that information is introduced by means of a control keyboard comprising the interface HMI man-machine.

The grippers CL of the selected printing units of the cylinders C1 . . . Cn are closed, so that these cylinders are kinematically secured to the transmission shaft MS and hence to the motor M. The closing operation of the grippers at the same time causes the lateral positioning of the cylinders. The lateral positioning of each cylinder brings the support of the cam CA opposite to the inductive sensor S. Consequently, once the cylinder rotates, the angular position of the cam CA can be detected by the sensor S. The lateral positioning is performed by the motor ML. In this example, it is a brushless motor which is controlled in its position by the programmed control electronics MCS of the machine. During production by the machine, this motor ML is used for the lateral register control.

The operation of initial angular adjustment of the engraved cylinders C1 . . . Cn for adjusting the peripheral register of the engraved cylinders of the successive printing units can then begin by using a central control located near the interface HMI.

The automatic sequence starts with a slow rotation of the motor until the index of the incremental encoder G, which causes a reset of the electronic counting register located in the control electronic MCS. The incremental encoder G follows the angular position of the downstream main axis of the reduction gears Z1/Z2. The resolution at the level of the engraved cylinders C1 . . . Cn of this electronic counting register is of 4096×4=16384 pulses per revolution of these cylinders. In mm, this resolution is of about 0.05 mm on the maximum size of the cylinders. The electronic counting system is reset with an index signal after at the most one revolution of the cylinders C1 . . . Cn. The incremental encoder G runs as long as the transmission shaft MS is driven by the main motor M, independently from the fact that an engraved cylinder C1 . . . Cn is active or not in the printing unit where it is mounted.

After the reset of the electronic counting register, the scanning of the angular positions of the cams CA by the inductive sensor can begin. The angular position of each cylinder C1 . . . Cn is registered at the time of passage of the cam CA before the sensor S. The register operation of all the cams CA must be made within one revolution of the engraved cylinders C1 . . . Cn. The information given by the sensor S of each engraved cylinder C1 . . . Cn is sent to the programmable electronics MCS by the bus BUS1 whose scanning period is of about 5 msec. The bus coupler BC for multiplexing the information is located near the sensor S.

When the position of each cylinder is known, the programmable electronics MCS starts a calculation determining the phase difference to be given to each engraved cylinder C1 . . . Cn for the register adjustment with the reference cylinder C1 which prints the first color. The calculation of the successive phase differences is based on the web lengths between the printing units and on the printed size, i.e. on the peripheral length or circumference of the engraved cylinders. The lengths are calculated in accordance with the choices the operator has made by using the keyboard of interface HMI. At each distance between the unit N and the reference unit R, there is associated an angle of phase difference to be made on the unit N (2<=N<=Nmax). This angle is proportional to the remaining amount of the whole division between the distance d(N−R) and the printing size. The result of this calculation is a list of values expressed in degrees. The programmable electronics MCS arranges the list of values in the ascending order.

The programmable electronics MCS drives the main motor M in order to bring the first engraved cylinder C1 . . . Cn from the list of values into the desired angular position. Once the position reached, the motor M stops and the gripper CL of the engraved cylinder C1 . . . Cn is open, as illustrated for the cylinder C2. Therefore, the cylinder C2 is disconnected from the transmission shaft MS.

The adjustment operation continues by positioning all the other engraved cylinders C1 . . . Cn in the ascending phase difference order according to the list of values and by using the same method as the one used for the engraved cylinder C2. The advantage of this method is that the engraved cylinders C1 . . . Cn which have a greater angular displacement benefit from the angular displacements of the engraved cylinders preceding them in the list of values. With this method all the engraved cylinders C1 . . . Cn can be positioned in one revolution of the encoder G. This sequence requires at the most 1 minute for a printing line comprising 10 selected printing units.

At the end of the adjustment method, all the engraved cylinders C1 . . . Cn are positioned. The programmable electronics MCS determines the end position of the engraved cylinders C1 . . . Cn with respect to the index of the encoder G. With this function, the position of the register cross CR of each engraved cylinder C1 . . . Cn with respect to the index of the encoder G can be known.

The information about the position of CR for each engraved cylinder C1 . . . Cn is sent to the register control system REG with the information relative to the distance in mm between the given printing point of an engraved cylinder C1 . . . Cn and the scanning point of the photocell RC associated to this engraved cylinder.

The register control system REG uses the aforesaid information relative to the position of the register mark CR of each engraved cylinder C1 . . . Cn and to the distance between the printing point and the scanning point, in combination with the knowledge of the distance LY between the printed register mark CM with respect to the register marks CR of the engraved cylinder C1 . . . Cn. This distance LY is introduced by the operator at the time of a job configuration. For the register system, these three kinds of information are necessary and sufficient for adjusting the opening of a scanning window of the register control system REG at the time of passage of the marks RM, CM on the printed size in the field of vision of the scanning photocells RC connected to the register control system REG. The calculation of these parameters including the sending to the register control system REG through the BUS2 generally requires less than 2 seconds.

After this adjustment, the machine can be started, the colors will be in phase and the register control system REG is synchronised for scanning the register marks RM, CM in the window set on the passage of these marks in the field of vision of the scanning photocells RC.

If the printing machine, for which the adjustment method is described herein, is associated with an inline diecutting module, the shape of the blank can be adjusted with respect to the printing of the printing machine. The register adjustment of the diecutting module will be obtained by the register control system REG of the printing machine owing to a digital oscilloscope.

Therefore, with the method of the present invention, the initial adjustment of a multicolor printing machine is completely automatic and without web consumption. The total time for working this adjustment operation should not exceed 2 minutes.

Although the present invention has been described in relation to particular embodiments thereof, many other variations and modifications and other uses will become apparent to those skilled in the art. It is preferred, therefore, that the present invention be limited not by the specific disclosure herein, but only by the appended claims.

What is claimed is:

1. Apparatus for initial adjustment of a peripheral register of engraved cylinders of successive printing units of a rotary multicolor printing press, comprising a transmission line, a main motor driving the main line to rotate;

a plurality of engraved cylinders, clutching devices for selectively connecting the engraved cylinders to the transmission line;

a register mark at a determined angular position on each engraved cylinder, a respective detector of each register mark;

an incremental encoder of the angular position of the engraved cylinders; a programmable control connected to the incremental encoder, to the detector, to the clutching devices and to an interface for introducing operating parameters of a job to be run; and a device enabling applicable initial adjustments of the cylinders based on their initial positions and the operating parameters of the job.

2. The apparatus according to claim 1, wherein the programmable control is connected to a frequency modulator for the motor and to an encoder for speed and position control of the motor.

* * * * *